US006236378B1

(12) United States Patent
Van Loon

(10) Patent No.: US 6,236,378 B1
(45) Date of Patent: May 22, 2001

(54) ANTENNA AND CORDLESS TELECOMMUNICATION APPARATUS COMPRISING AN ANTENNA

(75) Inventor: Lambertus J. W. Van Loon, Huizen (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 08/329,113

(22) Filed: Oct. 25, 1994

(30) Foreign Application Priority Data

Oct. 25, 1993 (BE) ..... 9301134

(51) Int. Cl.[7] ..... H01Q 1/36

(52) U.S. Cl. ..... 343/895; 343/895; 343/702; 343/728; 343/748

(58) Field of Search ..... 343/895, 702, 343/728, 748, 741, 742, 866, 867, 868

(56) References Cited

U.S. PATENT DOCUMENTS

| | | | | |
|---|---|---|---|---|
| 2,482,767 | * | 9/1949 | Hansen | 343/895 |
| 2,755,469 | * | 7/1956 | Etheridge | 343/895 |
| 3,235,805 | * | 2/1966 | Hings | 325/374 |
| 3,757,345 | * | 9/1973 | Carver | 343/895 X |
| 4,137,534 | * | 1/1979 | Goodnight | 343/895 X |
| 4,780,727 | * | 10/1988 | Seal | 343/895 |

* cited by examiner

*Primary Examiner*—Tho Phan

(57) ABSTRACT

The antenna (1) includes a first conductor (2) folded in a plurality of loops (3) which at least partly overlap, seen in a first direction (z). As a result, the antenna (1) seen in the first direction (z) is compact and is therefore highly suitable for incorporation in the housing of, for example, a cordless telephone.

6 Claims, 2 Drawing Sheets a = 850 MHz
e = 1000 MHz

ANTENNA AND CORDLESS TELECOMMUNICATION APPARATUS COMPRISING AN ANTENNA

BACKGROUND OF THE INVENTION

The invention relates to an antenna, comprising a first conductor having a length of substantially a quarter wavelength of electromagnetic waves to be transmitted and/or received by the antenna.

The invention further relates to a cordless telecommunication apparatus comprising an antenna, which antenna includes a first conductor having a length of substantially a quarter wavelength of electromagnetic waves to be transmitted and/or received by the antenna. A cordless telecommunication apparatus is understood to mean, for example, telecommunication apparatus exchanging information by means of radio links. Such cordless telecommunication apparatuses are, for example, a telephone operating according to the CT1 standard or a pager.

Known quarter wavelength antennas are the antennas used in cordless telephones manufactured by Hagenuk operating around 900 MHz. They consist of a PCB (Printed Circuit Board) on which a conductor functioning as an antenna is realised. The conductor consists of sections positioned in a first direction, connected to each other by means of sections positioned substantially perpendicular to the first direction. As a result, an antenna structure is obtained taking up rather much space in the first direction. Especially if such an antenna is to be accommodated in the housing of a cordless telephone or pager this is a drawback, because in view of the ever continuing miniaturization of such equipment it is desirable to keep the space to be used by the antenna as small as possible.

SUMMARY OF THE INVENTION

It is an object of the invention to provide an antenna of the type defined in the opening paragraph, which is more compact than the antenna already known.

An antenna according to the invention is characterized in that the first conductor comprises a plurality of at least partly overlapping loops stretching out in a first direction seen from an antenna base. As a result, the antenna is more compact in the first direction than the antenna already known, so that less space for an antenna is needed in the housing of a cordless telephone or a pager. Measurements have shown that the performance of the antenna according to the invention is equivalent to that of the Hagenuk antenna. Furthermore, the antenna is rather insensitive to minor dimensional modifications. This leads to the fact that the antenna can easily be adapted to different requirements with respect to dimensions.

Therefore, an embodiment for the antenna according to the invention is characterized in that the antenna comprises a second conductor which is mirror-symmetrical relative to the first conductor, an axis of symmetry coinciding with the first direction.

A further embodiment for the antenna according to the invention is characterized in that the conductor is flexibly arranged freely. As a result, the antenna has a very simple structure.

A further embodiment for the antenna according to the invention is characterized in that the conductor is fixedly arranged, e.g. a printed circuit board. Since the overlapping loops are not to have any electrical contact, it is necessary for the printed circuit board to be double faced. The advantage of introducing the conductor on a printed circuit board is the large mechanical stability of the antenna.

A further embodiment for the antenna according to the invention is characterized in that the conductor is made of insulated copper wire. This is a very inexpensive conductor which has as an advantage, if the conductor is flexibly arranged, that has a result of the sturdiness of the material no auxiliary means are necessary to maintain the shape of the antenna.

BRIEF DESCRIPTION OF THE DRAWING

The invention will be further explained with reference to a drawing in which.

DESCRIPTION OF THE PREFERRED EMBODIMENTS

Figure 1:
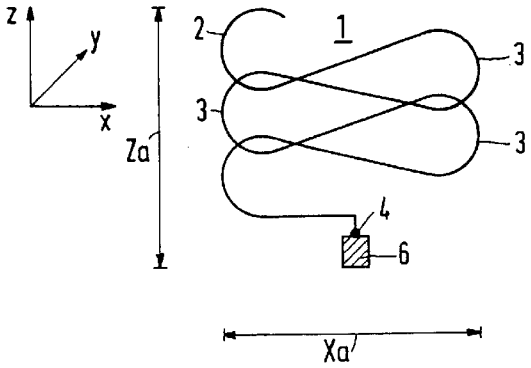
FIG. 1 shows an embodiment of an antenna according to the invention.

FIG. 1 shows an antenna 1 according to the invention. This antenna 1 comprises a first conductor 2 which has an overall length of about a quarter wavelength for a specific operational frequency. This conductor 2 is specific on a connector 6 near an antenna base 4, which connector may be connected to the RF part of a cordless telephone not shown here. The antenna 1 is arranged for frequencies of about 900 MHz. A quarter wavelength in this case is slightly over 8 cm. By winding the first conductor 2 in at least partly overlapping loops 3, the antenna 1 substantially arranged in a single plane has a dimension $z_a$ of 25 mm seen in a first direction z and a dimension $x_a$ of 25 mm seen in a second direction x perpendicular to the first direction z. In a third direction y perpendicular to z and x the antenna 1 has a very small dimension which depends on the thickness of the material used.

The conductor 2 may consist of copper fixedly mounted on a printed circuit board. This results in good mechanical stability of the antenna. The conductor 2 may also consist of insulated copper wire arranged flexdly. Since the insulated copper wire is rather sturdy, supporting material is not absolutely necessary. This means that in that case the antenna 1 is very simple.

The antenna 1 shown in FIG. 1 comprises three loops 3. However, the operation of the antenna does not change much if the number of loops slightly increases or decreases. This means that the antenna 1 may simply be adapted if requirements made on the dimensions are changed. Needless to observe that the overall length of the conductor 2 does have to be about a quarter wavelength. The antenna is further insensitive to slight dimensional modifications. If the antenna is arranged, for example, in a cordless telephone, no manual tuning is necessary. This is an important advantage for volume production.

Commonly, the impedance of a quarter wavelength antenna 1 at the resonant frequency is lower than 50 Ohms. Preferably, the antenna 1 is to be adapted to 50 Ohms. This may be simply realized by inserting an LC section between the antenna 1 and the connector 6. The connector 6 already has a capacitance. By making the conductor 2 slightly longer than a quarter wavelength, the impedance of the antenna 1 becomes inductive. In this manner an LC section is connected in series with a quarter wavelength antenna 1 in which operation the connector 6 is involved. By not adding additional components for the adaptation, the dimension $z_a$ in the first direction z remains small.

Figure 2:
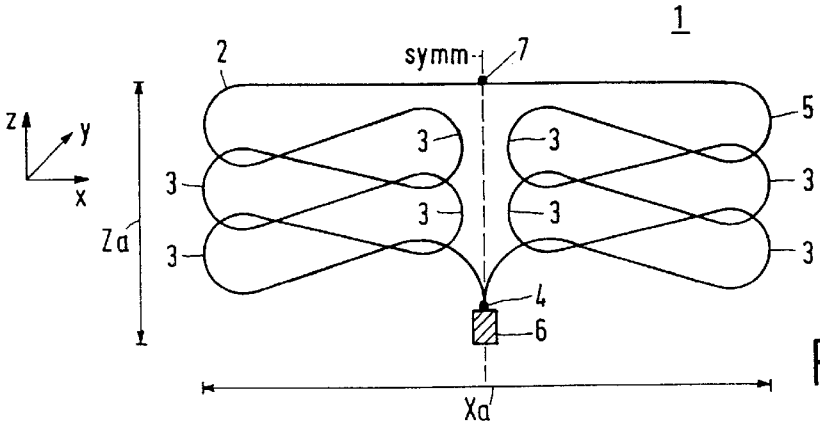
FIG. 2 shows a further embodiment of an antenna according to the invention.

FIG. 2 shows a further embodiment of an antenna 1 according to the invention. Herein a second conductor 5 is arranged mirror-symmetrically with respect to the first conductor 2. An axis of symmetry symm coincides with the first direction z. The dimensions are: $z_a$=25 mm and $x_a$=45 mm. This embodiment is as compact in the first direction z as the antenna shown in FIG. 1. The first conductor 2 and the second conductor 5 may optionally be connected in a point 7 on the axis of symmetry symm. Furthermore, the first conductor 2 and the second conductor 5 may both be formed from a single piece of copper wire of about a one-half wavelength.

Figure 3:
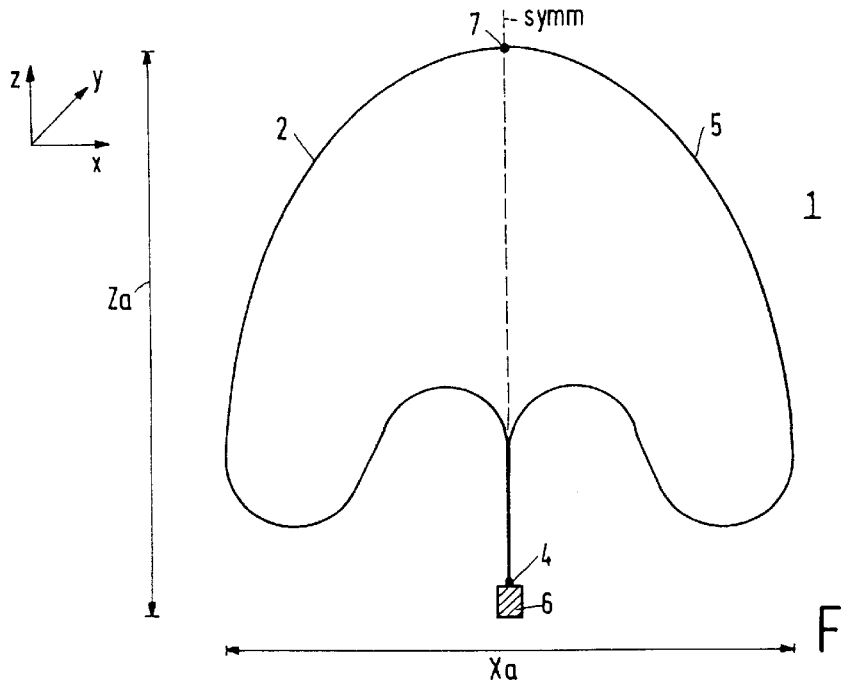
FIG. 3 shows an antenna having an umbrella shape.

FIG. 3 shows an antenna forming an umbrella-shaped section in the plane (x,z). It comprises a first conductor 2 and a second conductor 5 positioned mirror-symmetrically with respect to each other. The axis of symmetry symm coincides with a first direction z. The ends of the two conductors are connected in the antenna base 4 and in point 7 lying on the axis of symmetry symm. Seen from the antenna base 4, the first conductor 2 and the second conductor 5 are folded inwards to provide that the dimension $z_a$ in the first direction z remains small. The dimensions of the umbrella-shaped antenna 1 are: $z_a$=45 mm and $x_a$=45 mm.

Figure 4:
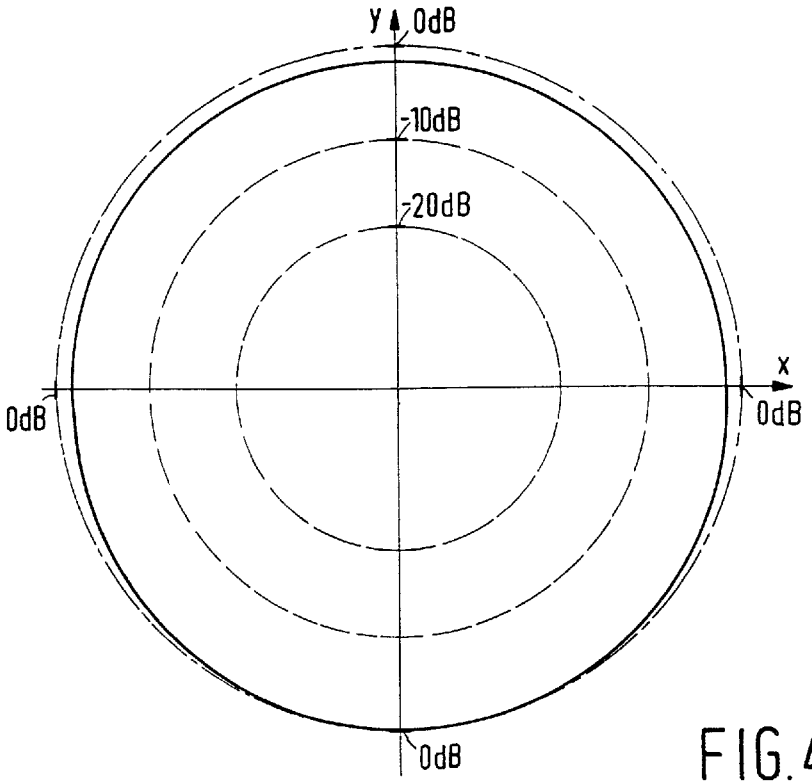
FIG. 4 shows the radiation pattern of the antenna shown in FIG. 1.

FIG. 4 shows the radiation pattern normalized to 0 dB of the antenna 1 shown in FIG. 1, having a frequency of 924 MHz and in a plane x,y perpendicular to the first direction z. The direction of polarization of the waves is equal to the first direction z. The radiation pattern is substantially omnidirectional. This is a favorable property for antennas used in cordless telephony.

Figure 5:
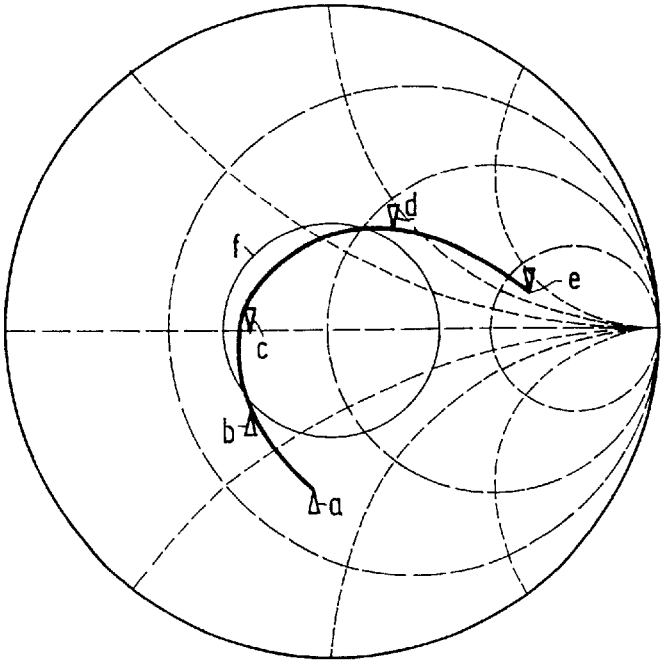
FIG. 5 shows a Smith chart representing the impedance of the antenna shown in FIG. 1 normalized at 50 Ohms.

FIG. 5 shows a Smith chart representing the impedance of the antenna 1 shown in FIG. 1 normalized to 50 Ohms. The frequency is varied between 850 MHz and 1000 MHz. The frequencies 850 MHz, 875 MHz, 900 MHz and 950 MHz and 1000 MHz are referenced a, b, c, d and e, respectively. The VSWR (Voltage Standing Wave Ratio) is smaller than 2 if the impedance curve is in the circle f. This is the case over a bandwidth of about 100 MHz. This is amply sufficient for use of the antenna 1 in, for example, a cordless telephone operating according to the CT1 standard.

The antenna 1 according to the invention is not only applicable at frequencies around 900 MHz, but also (with modified length of the conductor 2) at other frequencies used for cordless communication such as 450 MHz and 1800 MHz.

What is claimed is:

1. Antenna (1) comprising a first conductor (2) having a length of substantially a quarter wavelength of electromagnetic waves to be transmitted and/or received by the antenna (1), characterized in that the first conductor (2) comprises a plurality of at least partly overlapping loops (3) stretching out in a first direction (z) seen from an antenna base (4), said loops lying substantially in a common plane.

2. Antenna (1) as claimed in claim 1, characterized in that the antenna (1) comprises a second conductor (5) which is mirror-symmetrical relative to the first conductor (2), an axis of symmetry (symm) coinciding with the first direction (z).

3. Antenna (1) as claimed in claim 1 or 2, characterized in that the first conductor (2) is flexidly arranged.

4. Antenna (1) as claimed in claim 1 or 2, characterized in that the first conductor (2) is fixedly arranged.

5. Antenna (1) as in claim 1 or 2, characterized in that the first conductor (2) comprises insulated conductive wire.

6. Cordless telecommunication apparatus comprising an antenna, which includes a first conductor (2) having a length of substantially a quarter wavelength of electromagnetic waves to be transmitted and/or received by the antenna (1), characterized in that the first conductor (2) comprises a plurality of at least partly overlapping loops (3) stretching out in a first direction (z) seen from an antenna base (4), said loops lying substantially in a common plane.

* * * * *